United States Patent [19]

Ogawa

[11] 4,434,533

[45] Mar. 6, 1984

[54] HIGH DRAFT APPARATUS FOR WORSTED SPINNING PROCESS

[75] Inventor: Goro Ogawa, Mie, Japan

[73] Assignee: Nakagawa, Seisakusho Co., Ltd., Japan

[21] Appl. No.: 349,850

[22] Filed: Feb. 18, 1982

[51] Int. Cl.[3] ..... D01H 5/86

[52] U.S. Cl. ..... 19/247; 19/258

[58] Field of Search ..... 19/236, 244, 247, 248, 19/258

[56] References Cited

U.S. PATENT DOCUMENTS

| | | | |
|---|---|---|---|
| 2,471,057 | 5/1949 | Bird | 19/247 |
| 3,339,243 | 9/1967 | Sato | 19/247 X |

FOREIGN PATENT DOCUMENTS

| | | | |
|---|---|---|---|
| 339780 | 6/1904 | France | 19/258 |
| 41-6618 | 4/1966 | Japan | 19/247 |
| 14191 | of 1903 | United Kingdom | 19/258 |

*Primary Examiner*—Louis Rimrodt

*Attorney, Agent, or Firm*—Barnes, Kisselle, Raisch, Choate, Whittemore & Hulbert

[57] ABSTRACT

A high draft apparatus for use in the worsted spinning process. At the gilling or bobinoir step of the worsted spinning process, a porcupine roller and a middle roller are disposed between a front roller and a back roller to prevent an occurrence of unevenness and to obtain a uniform sliver.

12 Claims, 7 Drawing Figures

HIGH DRAFT APPARATUS FOR WORSTED SPINNING PROCESS

BACKGROUND OF THE INVENTION

As shown in FIGS. 1 and 2, in the conventional gill C and bobinoir D, a sliver 12 is controlled by needles 10*a* of a follower 10 or needles 11*a* of a porcupine roller 11 to impart a draft to the sliver 12.

In a recently developed draft apparatus in which high drafting is made possible while increasing the drafting speed, for example, as shown in FIG. 3, an intermediate roller 13 comprising a balloon rollers 13*a* and a lower apron 13*b* is arranged, or as shown in FIG. 4, an intermediate roller 14 comprising double aprons 14*a* and 14*b* is arranged as a substitute for the follower or porcupine roller. These high drafting operations are performed without using needles, whereby the draft ratio and drafting speed can be increased.

However, these high draft apparatuses are defective in the following points as compared with the draft apparatus comprising a follower or porcupine roller.

(1) The evenness of a sliver is low and yarn breakages are readily caused in a spinning frame.

(2) Defects of a sliver caused at the preceding steps are not substantially eliminated but are sometimes worsened.

(3) Occurence of unevenness by joining of slivers in not prevented at all.

Each of the recently developed high draft apparatuses is of an apron type or similar type as shown in FIGS. 3 or 4, and it is an indispensable requirement that an ideal and good sliver should be supplied. However, incorporation of a defective sliver or a sliver having defects cannot practically be avoided, and the above-mentioned defects (1) and (2) are caused in the practical operation. Namely, when such defective sliver is supplied, abnormal expansion of the sliver is more prominent than in the conventional low draft apparatus, and yarn breakages are frequently caused in a spinning frame, resulting in reduction of the yarn quality.

The defect (3) will now be described. As shown in FIG. 5, before a sliver 12 supplied from a can 15 is completely consumed, the top end 212*a* of a sliver 212 taken out from a full can 215 which is let to stand by for the subsequent supply is partially lapped on the rear end 12*a* of the sliver 12 of the can 15 and joining is performed. Since needles are not nused in the high draft apparatus as pointed out herein-before, the formed joint is not normally drafted but a defect of unevenness appears on the joint, and this uneven portion should be removed afterwards. Because of this operation loss, the effects of increasing the operation speed and the productivity cannot satisfactorily be attained, and this disadvantage is especially serious when an automatic doffing apparatus is arranged.

Unevenness of sliver of this type cannot be checked by the naked eye and the sliver is directly forwarded to a spinning frame, and when an uneven yarn is spun and a fabric is formed by knitting or weaving, this defect is first found out and the poor quality becomes a problem. One of the reasons why adoption of a high draft bobinoir is hesitated is a risk of this poor quality.

SUMMARY OF THE INVENTION

The present invention relates to a high draft apparatus disposed at the gilling or bobinoir step broadly adopted in the worsted spinning process.

An object of the present invention is to provide a high draft apparatus, in which a uniform sliver can be formed by high drafting and occurrence of unevenness is prevented at the time of joining slivers.

In the present invention both the needles and aprons are applied for drafting slivers so that merits of both the needles and aprons are utilized while their demerits are eliminated. More specifically, according to the present invention, there is provided a novel draft apparatus, in which massive migration of fibers at the operation of joining slivers is controlled by the action of the needles and simultaneously, the aprons are driven and rotated by the forefront roller in such a manner as if the aprons are moved to draw in the sliver, whereby the action of holding and delivering a sliver by the aprons can be performed very smoothly and the drafting operation can be accomplished precisely with certainty, with the result that the evenness of the sliver can be improved and a sliver free of unevenness due to joining can be obtained.

BRIEF DESCRIPTION OF DRAWINGS

FIG. 1 shows a gill comprising a follower.

FIG. 2 shows a bobinoir comprising a porcupine roller.

FIG. 3 shows a high draft bobinoir comprising a balloon roller and an apron.

FIG. 4 shows a high draft bobinoir comprising double aprons.

FIG. 5 illustrates the operation of joining slivers in the high draft bobinoir shown in FIG. 4.

DETAILED DESCRIPTION OF THE INVENTION

The structure of the present invention will now be described in detail with reference to embodiments illustrated in the accompanying drawings.

Figure 1:
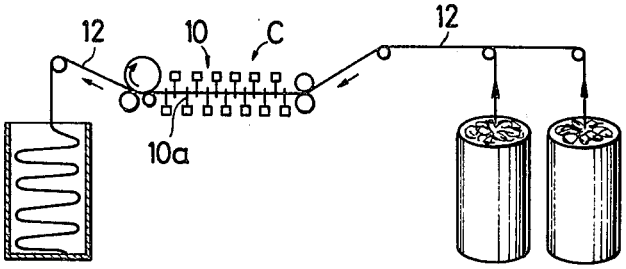
FIG. 1 PRIOR ART
FIGS. 1 through 5 are schematic side views showing conventional draft apparatuses.
Figure 2:
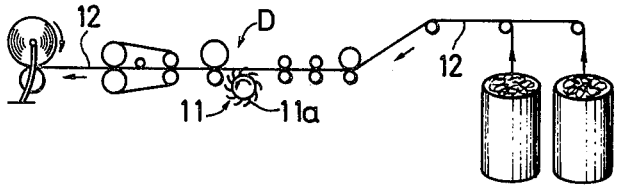
FIG. 2 PRIOR ART
Figure 3:
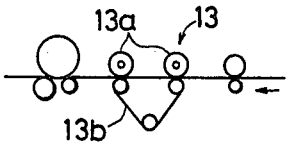
FIG. 3 PRIOR ART
Figure 4:
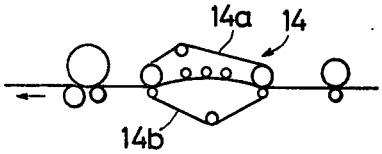
FIG. 4 PRIOR ART
Figure 5:
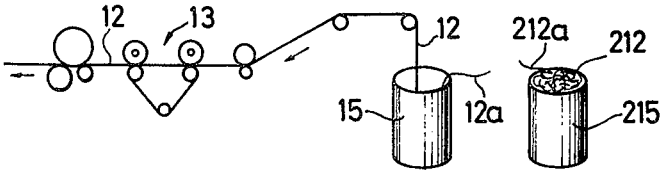
FIG. 5 PRIOR ART
Figure 6:
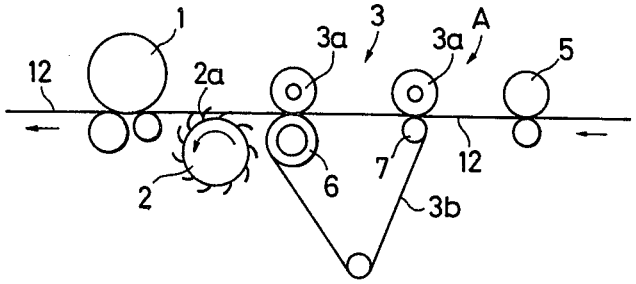
FIG. 6 is a schematic side view illustrating one embodiment of the high draft apparatus according to the present invention.
Figure 7:
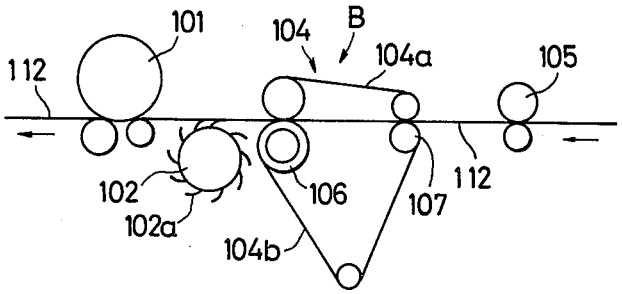
FIG. 7 is a schematic side view illustrating another embodiment of the present invention.

FIGS. 6 and 7 show embodiments of the draft apparatus of the present invention, and in each of FIGS. 6 and 7, reference numerals 1, 101 and 5, 105 represent a front roller and a back roller, respectively. In the draft apparatus A shown in FIG. 6, a porucpine roller 2 and an intermediate roller 3 comprising a balloon roller 3*a* and an apron 3*b* are arranged in this order between both the front and back rollers 1 and 5, and in the draft apparatus B shown in FIG. 7, an intermediate roller 104 comprising upper and lower double aprons 104*a* and 104*b* is arranged instead of the intermediate roller 3 comprising the balloon roller 3*a* and the apron 3*b*, which is arranged in the apparatus A. The lower apron 3*b* or 104*b* is driven and rotated by the forefront roller 6 or 106 of a plurality of rollers supporting the apron 3*b* or 104*b*, that is, a roller 6 or 106 on the side of the porcupine roller 2 or 102. For this purpose, a saw teeth-like shape is given to the surface of the roller 6 or 106, or the surface of the roller 6 or 106 is roughened, and by the frictional force, the apron 3b or 104b is positively driven and rotated. In the intermediate roller comprising the apron and balloon roller or the intermediate roller comprising the double rollers, the lower apron 3b or 104b is taken out and driven by the forefront roller 6 or 106. Accordingly, sagging of the sliver-holding surface which is caused by feed-out driving by the rear roller 7 or 107 in the conventional apparatus is not caused at all. Furthermore, the intermediate roller is always rotated under tension and therefore, the sliver 12 or 112 can be smoothly fed to this intermediate roller from the back roller. This effect by the apron-driving system is especially prominent when the drafting rate is increased.

The porcupine roller 2 or 102 is arranged between the front roller 1 or 101 and the intermediate roller 3 or 104 and is rotated in the same direction as the sliver delivery direction while parts of needle points 2a or 102a are intruded into the sliver 12 or 112. Accordingly, the sliver 12 or 112 delivered between the front roller 1 or 101 and the intermediate roller 3 or 104 undergoes a final draft and is stretched at this porcupine roller 2 or 102 so that the sliver 12 or 112 is delivered out from the front roller 1 or 101 while having a predetermined thickness. Simultaneously, massive migration of fibers because of unevenness or irregular parallelism is prevented by intrusion fof needle points 2a or 102a into the sliver 12 or 112 and by this control action of the porcupine roller 2 or 102, the sliver is guided into the front roller 1 or 101 as a uniform fiber assembly. The draft is hardly given between the back roller and the intermediate roller but a predetermined quantity of the draft is given between the intermediate roller and the front roller. In the present invention, for example, the draft quantities are adjusted to 1.00 between the back roller and the intermediate roller (the apron) and to 0.90 in the zone of the porcupine roller, and the draft quantity is adjusted to 12.0 in the zone of the front roller. In this high draft zone, the sliver receives the control action of needles in the sufficiently stretched state. Accordingly, unevenness is remarkably reduced. Especially, massive migration of lapped fibers at the time of ending of slivers is effectively controlled by this porcupine roller, and a sliver having a very good evenness can be manufactured.

As will be apparent from the foregoing description, according to the present invention, between a front roller and a back roller at the gilling or bobinoir step of the worsted spinning process, a porcupine roller is arranged on the side of the front roller and an intermediate roller comprising double aprons or a balloon roller and an apron is arranged on the side of the back roller to construct a series of a draft apparatus, and the apron is driven and rotated by the forefront roller of rollers supporting said apron. By virtue of such characteristic features, the spron of the intermediate roller is rotated in the state where the sliver-holding surface is kept under tension, and therefore, the sliver supplied from the back roller is smoothly held and delivered out under tension without being bent. Accordingly, a high draft can always be given to the sliver precisely, and by the combing action of the porcupine roller, fibers of the sliver are sufficiently controlled and uneveness due to the joining operation is not caused to occur at all. Therefore, a sliver having a good uniformity and being free of unevenness can always be spun out. Furthermore in the present invention, the porcupine roller and the intermediate roller comprising a lower apron and an upper balloon roller or double roller 3, which is positively driven and rotated by the forefront roller, can easily be constructed by modifying and remodeling the conventional gill or bobinoir. Moreover, by such arrangement of the porcupine roller and such driving of the apron, high draft is made possible and the effects of stabilizing the quality, preventing formation of a defective joint, eliminating the operation loss and improving the operation efficiency can be attained.

What is claimed is:

1. A high draft apparatus for use in the worsted spinning process wherein between a front roller and a back roller at the gilling or bobinoir step of the worsted spinning process a porcupine roller is arranged on the side of the front roller, and an intermediate roller separate from and not engaged with the porcupine roller is arranged on the side of the back roller between the back roller and separate porcupine roller to construct a series of a draft apparatus.

2. A high draft apparatus as claimed in claim 1, wherein said intermediate roller comprises double aprons.

3. A high draft apparatus as claimed in claim 2, wherein said apron is driven and rotated by the forefront roller of rollers supporting the apron.

4. A high draft apparatus as claimed in claim 3, wherein the circumferential surface of the forefront roller which drives the apron is roughened.

5. A high draft apparatus as claimed in claim 1, wherein said intermediate roller comprises a balloon roller and an apron.

6. A high draft apparatus as claimed in claim 5, wherein said apron is driven and rotated by the forefront roller of rollers supporting the apron.

7. A high draft apparatus as claimed in claim 6, wherein the circumferential surface of the forefront roller which drives the apron is roughened.

8. A high draft apparatus for use in the worsted spinning process wherein between a front roller and a back roller at the gilling or bobinoir step of the worsted spinning process, a porcupine roller is arranged on the side of the front roller and an intermediate roller separate from and not engaged with the porcupine roller is arranged on the side of the back roller between the back roller and separate porcupine roller to construct a series of a draft apparatus and wherein the draft between the back roller and intermediate roller is substantially 1.00, the draft in the zone of the porcupine roller is substantially 0.90 and the draft in the zone of the front roller is substantially 12.00.

9. A high draft apparatus as claimed in claim 8, wherein said intermediate roller comprises double aprons.

10. A high draft apparatus as claimed in claim 9, wherein one of said aprons is driven and rotated by the forefront roller of rollers supporting the one apron.

11. A high draft apparatus as claimed in claim 8, wherein said intermediate roller comprises a balloon roller and an apron.

12. A high draft apparatus as claimed in claim 11, wherein the apron is driven and rotated by the forefront roller of rollers supporting the apron.

* * * * *